US008624792B2

(12) United States Patent
Popugaev et al.

(10) Patent No.: US 8,624,792 B2
(45) Date of Patent: Jan. 7, 2014

(54) ANTENNA DEVICE FOR TRANSMITTING AND RECEIVING ELECTROMEGNETIC SIGNALS

(75) Inventors: Alexander Popugaev, Erlangen (DE); Rainer Wansch, Baiersdorf-Hagenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 320 days.

(21) Appl. No.: 12/524,937

(22) PCT Filed: Jan. 23, 2008

(86) PCT No.: PCT/EP2008/000504
§ 371 (c)(1),
(2), (4) Date: Jul. 29, 2009

(87) PCT Pub. No.: WO2008/092592
PCT Pub. Date: Aug. 7, 2008

(65) Prior Publication Data

US 2011/0050529 A1 Mar. 3, 2011

(30) Foreign Application Priority Data

Jan. 30, 2007 (DE) ..... 10 2007 004 612

(51) Int. Cl.
*H01Q 19/32* (2006.01)
*H01Q 21/24* (2006.01)
*H01Q 21/29* (2006.01)

(52) U.S. Cl.
USPC ..... 343/833; 343/846; 29/600

(58) Field of Classification Search
USPC ..... 343/833, 834, 846, 700 MS; 29/600
See application file for complete search history.

(56) References Cited

U.S. PATENT DOCUMENTS

| | | | | |
|---|---|---|---|---|
| 1,860,123 | A | 5/1932 | Yagi | |
| 5,200,756 | A | 4/1993 | Feller | |
| 5,767,807 | A * | 6/1998 | Pritchett | 342/374 |
| 6,181,279 | B1 | 1/2001 | Yan Hoozen | |
| 6,191,751 | B1 * | 2/2001 | Johnson | 343/834 |
| 6,204,825 | B1 * | 3/2001 | Wilz | 343/841 |
| 6,731,243 | B2 | 5/2004 | Taira et al. | |
| 6,741,220 | B2 | 5/2004 | Inoue | |
| 6,801,167 | B2 | 10/2004 | Shibata | |
| 7,079,078 | B2 | 7/2006 | Yuanzhu | |

(Continued)

FOREIGN PATENT DOCUMENTS

| | | |
|---|---|---|
| EP | 1 113 523 A1 | 7/2001 |
| EP | 1 536 511 A1 | 6/2005 |
| WO | 03/028156 A2 | 4/2003 |

OTHER PUBLICATIONS

Official Communication issued in International Patent Application No. PCT/EP2008/000504, mailed on Apr. 25, 2008.

(Continued)

*Primary Examiner* — Michael C Wimer
(74) *Attorney, Agent, or Firm* — Keating & Bennett, LLP

(57) ABSTRACT

An antenna device for transmitting and receiving electromagnetic signals. The antenna device includes a ground plane and a radiator arranged at an radiator distance above the ground plane. In addition, the antenna device includes a plurality of parasitic elements arranged, on the ground plane, around the radiator in a radially symmetric manner, the parasitic elements being electrically connected to the ground plane.

14 Claims, 8 Drawing Sheets

(56) References Cited

U.S. PATENT DOCUMENTS

| | | | | |
|---|---|---|---|---|
| 7,242,366 | B2 * | 7/2007 | Shibata | 343/893 |
| 7,429,952 | B2 | 9/2008 | Sun | |
| 7,450,082 | B1 | 11/2008 | Lopez | |
| 2002/0158798 | A1 | 10/2002 | Chiang et al. | |
| 2004/0201524 | A1 | 10/2004 | Yuanzhu | |
| 2004/0257292 | A1 | 12/2004 | Wang | |
| 2005/0146469 | A1 | 7/2005 | Sampo | |
| 2007/0146206 | A1 | 6/2007 | Sun | |

OTHER PUBLICATIONS

Tillman, J. et al., "The Use of a Ring Array as a Skip Range Antenna," Proceedings of the IRE, vol. 43, No. 11, Nov. 1955, pp. 1655-1660.
Hansen, W. et. al., "A New Principle in Directional Antenna Design," Proceedings of the Institute of Radio Engineers, vol. 26, No. 3, Mar. 1938, pp. 333-345.

* cited by examiner $$[S] = \frac{e^{-j\varphi_0}}{2}\begin{bmatrix} 0 & 1 & -j & -1 & j \\ 1 & 0 & 0 & 0 & 0 \\ -j & 0 & 0 & 0 & 0 \\ -1 & 0 & 0 & 0 & 0 \\ j & 0 & 0 & 0 & 0 \end{bmatrix}.$$

| antenna (manufacturer) | frequency band, GHz | 10 dB beam-width, ° | mass, g | dimensions, mm | price, EUR |
|---|---|---|---|---|---|
| MarAnt+ (JAVAD) | 1.55-1.61 1.21-1.27 | >140 | 492 | 142x142x53 | from 2230 |
| GPS-532 (NovAtel) | 1.56-1.59 1.21-1.24 | >135 | 198 | 119x76x19 | 943 |
| (SAN JOSE NAVIGATION) | 1.56-1.59 1.21-1.24 | - | 140 | 90x90x17 | - |
| | | | | | |
| **GNSS antenna (IIS-FhG)** | **1.16-1.61** | **>150** | **107 without housing** | **> 150x150x31** | **<500** |

| frequency, GHz | gain, dBic | 10 dB beam-width, ° |
|---|---|---|
| 1.16 | 4.25 | 178 |
| 1.23 | 3.52 | 183 |
| 1.30 | 3.55 | 177 |
| 1.56 | 3.63 | 161 |
| 1.59 | 3.67 | 154 |
| 1.61 | 3.16 | 154 |
FIGURE 6E
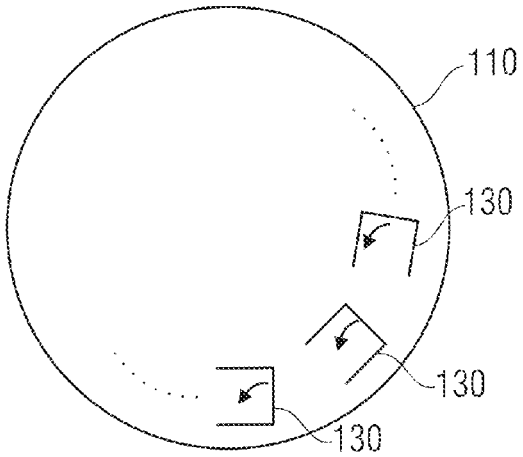
FIGURE 7
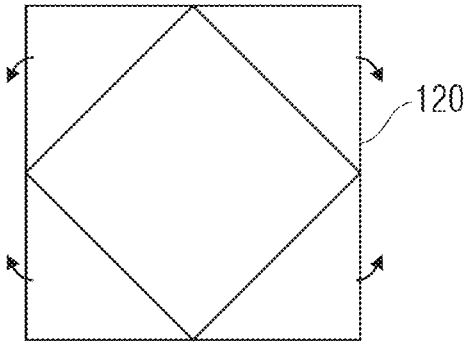
FIGURE 8

ANTENNA DEVICE FOR TRANSMITTING AND RECEIVING ELECTROMEGNETIC SIGNALS

The present invention relates to an antenna device for transmitting and receiving electromagnetic signals as are employed, for example, in navigation systems, in particular in satellite navigation systems such as GPS, GLONASS and Galileo.

BACKGROUND OF THE INVENTION

Navigation systems have spread considerably over the last few years. Currently, satellite-assisted navigation systems are utilized very intensively, and have already opened up the home consumer market. For example, the American satellite system GPS (global positioning system) or the Russian GLONASS (global navigation satellite system), which is equivalent to the internationally used umbrella term GNSS (global navigation satellite system), are already being used all over the world. The European system Galileo will also be put to use during the course of the next few years. It is expected that the Galileo system will be fully serviceable in four to five years' time.

The satellite navigation systems predominantly use a frequency range between 1 and 2 GHz. FIG. 9 shows the currently used frequency plan of the so-called lower L-band, the upper L-band and the C-band. In this context, the frequency ranges used are plotted across a frequency axis, which is indicated in units of MHz. The upper part of FIG. 9 represents the lower L-band, wherein all three navigation systems have frequencies associated with them. The individual frequency bands are employed for realizing open services (OS) as well as emergency applications (SOL, safety of life), commercial services (CS) and public services (PRS, public regulated services). In addition, the individual bands have identification codes associated with them, for example in the range from 1,164 MHz to 1,188 MHz, which is associated with the GPS system under the identification code L5, and with the Galileo system under the ID code E5A. In the bottom left area, FIG. 9 further shows the upper L-band, which is also used for navigation systems and is subdivided in a similar manner as the lower L-band. On the right-hand side of the bottom area, FIG. 9 shows the C-band, which is employed in the uplink of the Galileo system and which is within a frequency range of around 5 GHz. This frequency range is used for transmitting information from an earth station to a satellite.

To establish communication within said frequency ranges, antennas may be used which allow correspondingly precise localization of the satellites, and thus of the receiver. For precision applications, which, e.g., have accuracy requirements of less than five meters, attempts have been made to develop antennas which may be operated in all three frequency bands as far as possible. These antennas are currently offered, for example, by the Russian company Javad, www.javad.com, and by North American companies, www.novatel.com and www.sanav.com.

Mostly, antennas are available in one-band versions, such as GPS-L1, or in two-band variations, such as GPS-L1+L2. The current systems have the disadvantage that they are very costly. For example, multi-band systems are only available from a price level above 1,000 euros. Said systems mostly use planar structures on very expensive ceramic substrates, which play a decisive role in the high cost.

In addition, less costly antennas have been conventionally known, which, however, exhibit substantial disadvantages with regard to their levels of accuracy. For example, less costly antenna systems exhibit considerable drawbacks, e.g., with regard to their phase centers and their bandwidths. For example, fluctuations of the phase center in dependence on the angle of incidence are considerable, they comprise several centimeters, for example, and therefore turn out to be far larger than is allowed within the level of accuracy strived for. A further problem manifests itself in the compact design of such systems, which adversely affects their bandwidths and clearly reduces same. Such systems are therefore mostly one-band systems and thus only offer the possibility of receiving one frequency range; for example, only the reception of GPS signals is ensured.

SUMMARY

According to an embodiment, an antenna device for transmitting and receiving electromagnetic signals may have: a ground plane; a radiator arranged at a distance above the ground plane; and a plurality of parasitic elements arranged, on the ground plane, around the radiator in a radially symmetric manner, the parasitic elements being electrically connected to the ground plane and being arranged such that a beamwidth of the irradiation characteristic of the antenna device is enlarged.

According to another embodiment, a production method of producing an antenna device for transmitting and receiving electromagnetic signals may have the steps of: arranging a radiator at a distance above a ground plane; and arranging a plurality of parasitic elements, on the ground plane, around the radiator in a radially symmetric manner, the parasitic elements being electrically connected to the ground plane and being arranged such that a beamwidth of the irradiation characteristic of the antenna device is enlarged.

The core idea of the present invention is to influence the irradiation characteristic of an antenna by means of parasitic metallic elements surrounding same. Therefore, embodiments of the present invention are based on the finding that the irradiation characteristic—in this context, the term beamwidth is also used—of antennas may be matched by means of parasitic metallic elements. In this context, the parasitic elements are arranged around a radiator on a ground plane, as a result of which the irradiation characteristic is influenced, among other things, such that, within the frequency range of the navigation systems, a larger beamwidth of the irradiation characteristic may be achieved at the same antenna gain. This advantage is achieved by the described geometric arrangement of a ground plane, a radiator and of parasitic elements, so that said antenna systems may be realized at very low cost, which constitutes a further major advantage of embodiments of the present invention.

The inventive production method enables the setting up of antenna devices which realize circularly polarized broadband antennas having stable phase centers, almost constant antenna gains within, e.g., the frequency range of the navigation systems, and large beamwidths even at relatively high frequencies. What is advantageous about these systems is their low weight and the cheap production. This advantage is achieved since utilization of stacked microstrip line radiators on very expensive, brittle and heavy ceramic substrates may be dispensed with.

Other features, elements, steps, characteristics and advantages of the present invention will become more apparent from the following detailed description of preferred embodiments of the present invention with reference to the attached drawings.

BRIEF DESCRIPTION OF THE DRAWINGS

Embodiments of the present invention will be detailed subsequently referring to the appended drawings, in which:

FIGS. 6*a* to 6*e* show directivity patterns and table of embodiments of antenna devices;

FIG. 7 shows an embodiment of a ground plane;

FIG. 8 shows an embodiment of a radiator; and

DETAILED DESCRIPTION OF THE INVENTION

Figure 1A:
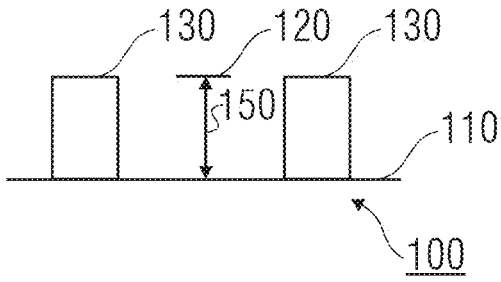
FIG. 1*a* shows a side view of an embodiment of an antenna device.

Before embodiments of the present invention will be explained in more detail below with reference to the figures, it shall be noted that, in the figures, identical elements are provided with identical or similar reference numerals and that repeated descriptions of said elements will be omitted.

FIG. 1*a* shows an antenna device 100 for transmitting and receiving electromagnetic signals. The antenna device 100 comprises a ground plane 110 and a radiator 120 which is arranged at an radiator distance 150 above the ground plane 110. The antenna device 100 further comprises a plurality of parasitic elements 130 arranged, on the ground plane 110, around the radiator 120 in a radially symmetric manner, the parasitic elements 130 being electrically connected to the ground plane 110. FIG. 1*a* shows the side view of an antenna device 100.

Figure 1B:
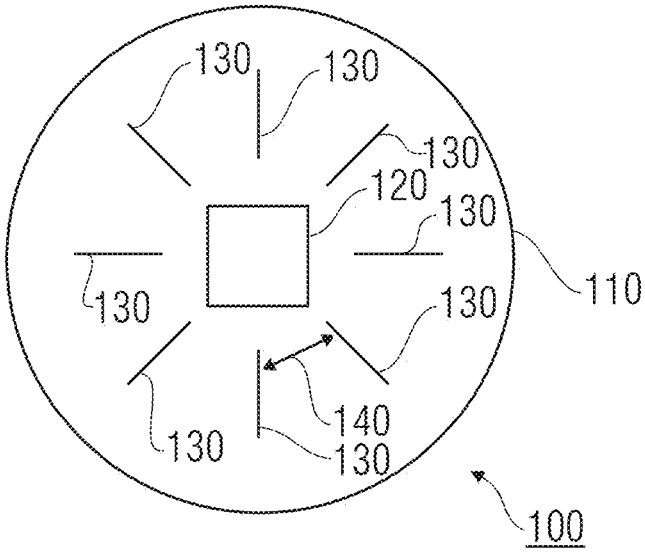
FIG. 1*b* shows a top view of an embodiment of an antenna device.

FIG. 1*b* shows a top view of the antenna device 100. The antenna device 100 comprises the ground plane 110 and the radiator 120, which is arranged at an radiator distance 150 above the ground plane 110. FIG. 1*b* also shows the plurality of parasitic elements 130, which are arranged, on the ground plane 110, around the radiator 120 in a radially symmetric manner, the parasitic elements 130 being electrically connected to the ground plane 110.

In one embodiment, the ground plane 110 comprises a surface area which falls below the square of a wavelength of the electromagnetic signals. The radiator 120 may comprise an radiator distance 150 which falls below a wavelength of the electromagnetic signals. In addition, in embodiments of the present invention, two parasitic elements 130 of the plurality of parasitic elements 130 may comprise, among themselves, an element distance 140 of less than one wavelength of the electromagnetic signals, and in an advantageous embodiment the element distance 140 is less than a quarter of the wavelength of the electromagnetic signals.

Embodiments of the present invention advantageously relate to antenna devices operating within a wavelength range of 0.15-0.3 m and are thus configured for a frequency range between 1 GHz and 2 GHz. However, embodiments of the present invention are not limited to said frequency range, for, in principle, the electromagnetic fields and, therefore, the antenna characteristics of any antenna may be influenced, in accordance with the invention, by parasitic elements.

It is only advantageously that embodiments of the present invention are employed in the GPS, Galileo or GLONASS systems, and, as a result, they are configured accordingly in embodiments.

In embodiments of antenna devices 100, the ground plane 110 may be made of metallic material and may comprise a circular, oval, square or rectangular shape. The radiator 120, for its part, may be formed, in embodiments, to be circular, oval, square or rectangular. In addition, the radiator 120 may be realized by a microstrip line radiator. In embodiments, the radiator 120 comprises a contacting which is passed through the ground plane 110.

Embodiments may comprise various parasitic elements 130. For example, rod-shaped, cubic or sector-shaped elements are conceivable. In one embodiment, for example, parasitic elements 130 might be implemented as elements which are partly worked from the ground plane 110. In this context it is conceivable, for example, that corresponding contours are worked from or released from the ground plane 110 by means of a laser. Thus, the parasitic elements 130 are initially part of the ground plane 110. Once the contours have been worked from the ground plane 110, the parasitic elements 130 may be bent away from the ground plane 110, or may be erected. In embodiments, the antenna device 100 may comprise more than four parasitic elements 130. In an advantageous embodiment, the antenna device 100 comprises six to twelve, advantageously eight or more parasitic elements 130.

In one embodiment, the antenna further exhibits the following properties:

- frequency range: 1.16-1.3 GHz and 1.56-1.61 GHz
- polarization: circular, RHCP (right-handed circular polarization)
- antenna gain larger than 3 dBic
- precisely defined and stable phase center
- 10 dB beamwidth larger than 150°
- FBR>10 dB (FBR=front-to-back ratio)
- low-cost realization Simulation results which have been achieved with the above properties or settings will be presented below. In the simulation, care was taken to ensure, above all, a 10 dB beamwidth of at least 150° across the entire frequency range.

It shall be noted at this point that another possible measure that may be taken in order to enlarge the beamwidth would be to use an electrically small radiator, which, however, has the disadvantage that the antenna gain decreases sharply within the lower frequency range once the desired beamwidth is attained.

In accordance with an embodiment of the present invention, an enlargement of the beamwidth at relatively high frequencies is achieved, in addition to increasing the antenna gain at relatively low frequencies, by introducing the parasitic metallic elements 130.

Figure 2A:
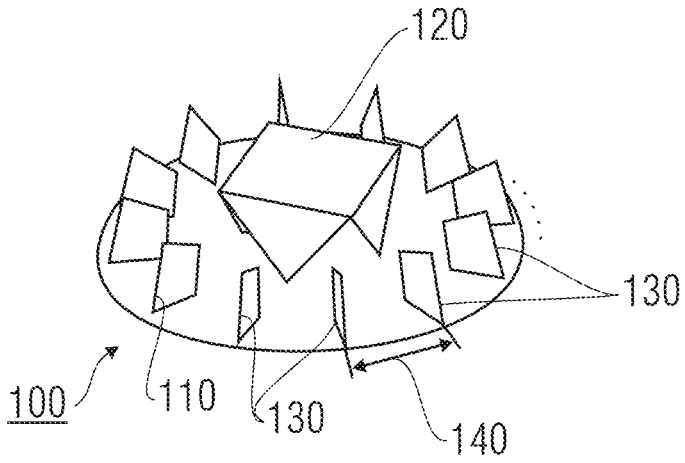
FIG. 2*a* shows a further embodiment of an antenna device.

FIG. 2*a* shows an embodiment of an antenna device 100 comprising a ground plane 110 and a radiator 120. FIG. 2*a* further shows the parasitic elements 130 which are arranged, on the ground plane 110, around the radiator 120 in a radially symmetric manner and are electrically connected to the ground plane 110. In this embodiment, the parasitic elements 130 are realized as parallelograms or flaps. In one embodiment, the element distance 140 between two parasitic elements 130 amounts to less than a wavelength of the electromagnetic signals, in an advantageous embodiment the element distance 140 amounts to less than a quarter of said wavelength. In addition, in an advantageous embodiment the radiator distance 150 may amount to less than a wavelength of the electromagnetic signals. In this context, FIG. 2*a* shows an implementation of the parasitic elements 130 as metallic ribs.

Figure 2B:
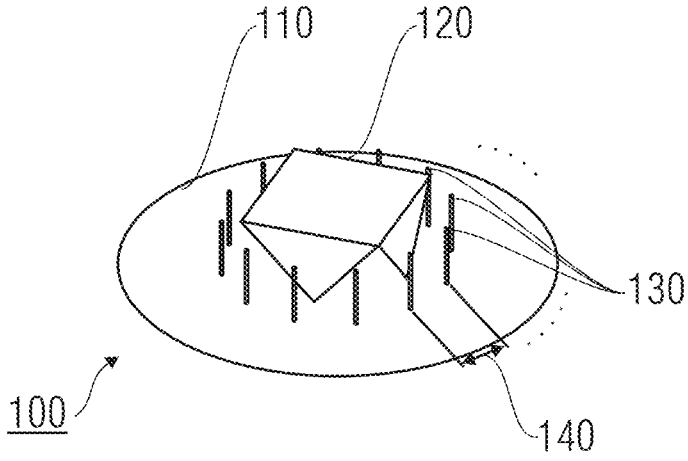
FIG. 2*b* shows an alternative embodiment of an antenna device.

FIG. 2*b* shows an alternative embodiment of an antenna device 100, wherein the parasitic elements 130 are implemented as metallic rods. In accordance with the above description, in an advantageous alternative embodiment, the element distance 140 might amount to less than a quarter of the wavelength of the electromagnetic signals, and the radiator distance 150 might amount to less than a wavelength of the electromagnetic signals.

Simulation results of a study of parameters will be summarized below.

1.
   radiator 40×40×20 mm (width×length×height) without parasitic elements
   VSWR (voltage standing wave ratio) 1.8:1
   antenna gain at 1.16 GHz=1 dBic
   dB beamwidth at 1.61 GHz=150°
2.
   radiator 50×50×30 mm without parasitic elements
   VSWR 1.8:1
   antenna gain at 1.16 GHz=4 dBic
   dB beamwidth at 1.61 GHz=130°
3.
   radiator 50×50×30 mm with parasitic elements
   VSWR 1.5:1
   antenna gain at 1.16 GHz=4 dBic
   dB beamwidth at 1.61 GHz=150°

Figures 3A, 3B:
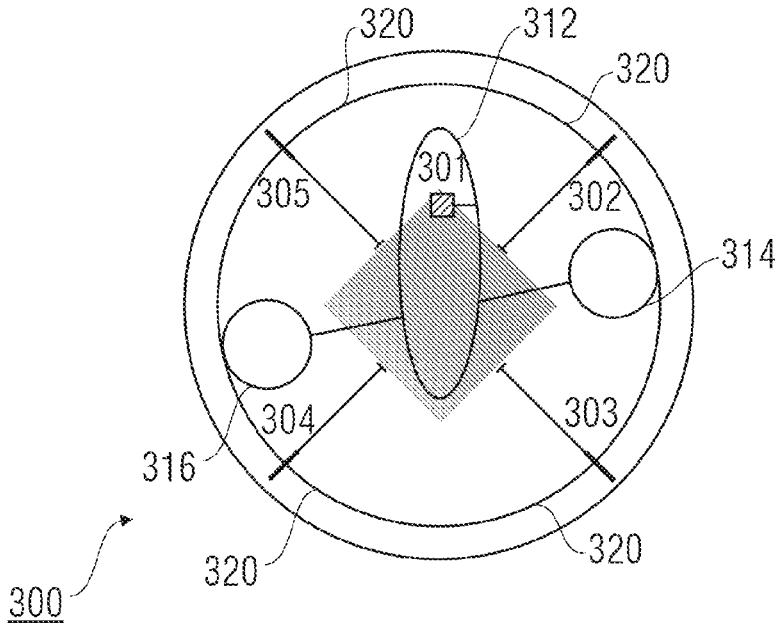
FIG. 3*a* shows an exemplary matching or feed network in an embodiment of an antenna device.
FIG. 3*b* shows an idealized scattering matrix of a matching/feed network of an embodiment of an antenna device.

In one embodiment, an inventive antenna device 100 is further used for generating circular polarization. To generate the circular polarization, the radiator 120 is excited at four points by a matching or feed network, which is located, in one embodiment, on the underside of the printed circuit board, or ground plane 110. FIG. 3*a* shows an embodiment of such a matching or feed network 300. The matching/feed network 300 comprises five feed points 301 to 305. A signal to be transmitted is fed in at point 301, is manipulated accordingly by a phase shifter, and is fed in at the sides of a radiator 120, which are connected to the feed points 302 to 305. A signal to be received may be tapped at the feed point 301 in an analogous manner.

In this embodiment, the matching/feed network 300 further comprises a phase shifter and four matching networks 320. In this embodiment, the phase shifter is implemented by a rat-race divider 312 and two Wilkinson dividers 314 and 316. The phase shifter composed of the rat-race divider 312 and the two Wilkinson dividers 314 and 316 provides for a corresponding phase shift for controlling the radiator 120 so as to achieve circular polarization. In this embodiment, the rat-race divider 312 is designed to be oval, but in other embodiments it may be circular, as it is usually implemented. The matching networks 320 serve to match the impedance of the antenna in this embodiment.

The feed network 300 of FIG. 3*a* implements a scattering matrix S of the embodiment, said scattering matrix S being depicted in FIG. 3*b*. In accordance with the five feed points 301 to 305 of the matching/feed network 300, the matrix has a 5×5 dimension. The circular polarization property of the feed network 300 manifests itself, in the scattering matrix S, in the scattering factors, which are shifted by 90° in each case, between the feed points 301 to 305.

To match the impedance of the antenna device 100, four identical matching networks 320 in accordance with this embodiment are used in the feed network 300. FIG. 4 once again shows the feed network 300 comprising the four matching networks 320. In this embodiment, each of the four matching networks 320 comprises a non-quarter-wave transformer 322 and two idling stubs 324 and 326. The antenna device 100 and the radiator 120 may therefore be matched in a broadband manner without using short-circuited stubs, which, in combination with a transformer, would be another method of broadband matching. By means of the selection of the radiator dimensions, i.e. its width and its radiator distance 150, the position of the impedance characteristic within a Smith diagram may be influenced. In one embodiment, the impedance characteristic may be optimized to such an extent that all of the admittance values lie within a vicinity of a circle of the conductance G=1. By correctly selecting the parameters of the two parallel closed idling stubs 324 and 326, and by correctly selecting the transformer 322, there is then the possibility, in this embodiment, of moving the admittance values to the center of the Smith diagram and to achieve optimum matching.

Therefore, embodiments of the present invention may comprise a matching or feed network 300 on the opposite side of the ground plane 110. The matching/feed network 300 may further comprise a rat-race divider 312 or a Wilkinson divider 314; 316. In a further embodiment, the matching/feed network 300 may further comprise a stub 326, a transformer 322 or a transformation line 322. Thus, embodiments of the present invention may also be configured to transmit or receive circularly polarized signals.

Figures 4, 5A:
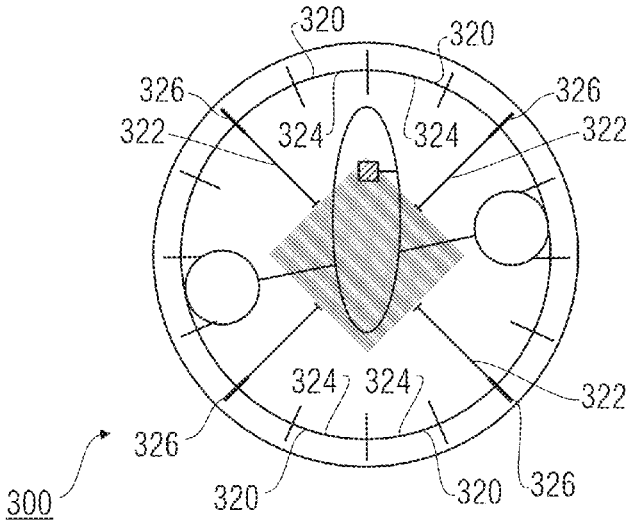
FIG. 4 shows an embodiment of a matching or feed network of an embodiment of an antenna device.
FIG. 5*a* shows a table of various comparison values between an embodiment and conventional systems.

For example, embodiments of the present invention offer the advantage that they have stable phase centers. In addition, they have larger bandwidths and larger beamwidths than conventional systems. In addition, they are characterized by their low mass and their low production cost, which is why they may advantageously be employed as GNSS antennas. FIG. 5*a* shows a table representing a comparison of various parameters of different antenna systems. The parameters of an embodiment of the present invention are represented in the last line and are compared to three conventional systems of the companies Javad, Novatel and SanJose-Navigation. The table of FIG. 5*a* reveals that the embodiment of the present invention in this comparison has the largest 10 dB beamwidth, has the lowest mass, covers the entire frequency range of the navigation systems and can be produced at the lowest cost.

Figure 5B:
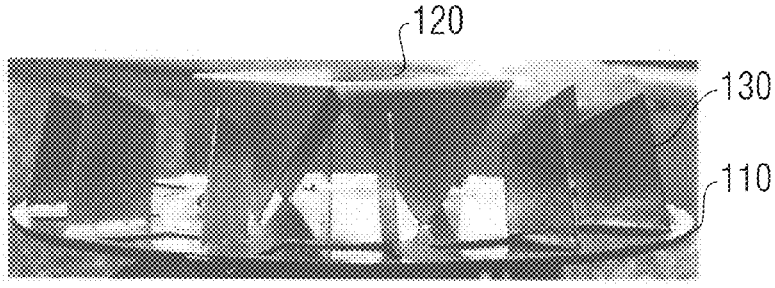
FIG. 5*b* shows a further embodiment of an antenna device.

FIG. 5*b* shows a realized GNSS antenna in accordance with an embodiment of the present invention for a frequency range of 1.16-1.61 GHz. The illustration 5*b* shows a ground plane 110, a radiator 120, and parasitic elements 130.

Figure 5C:
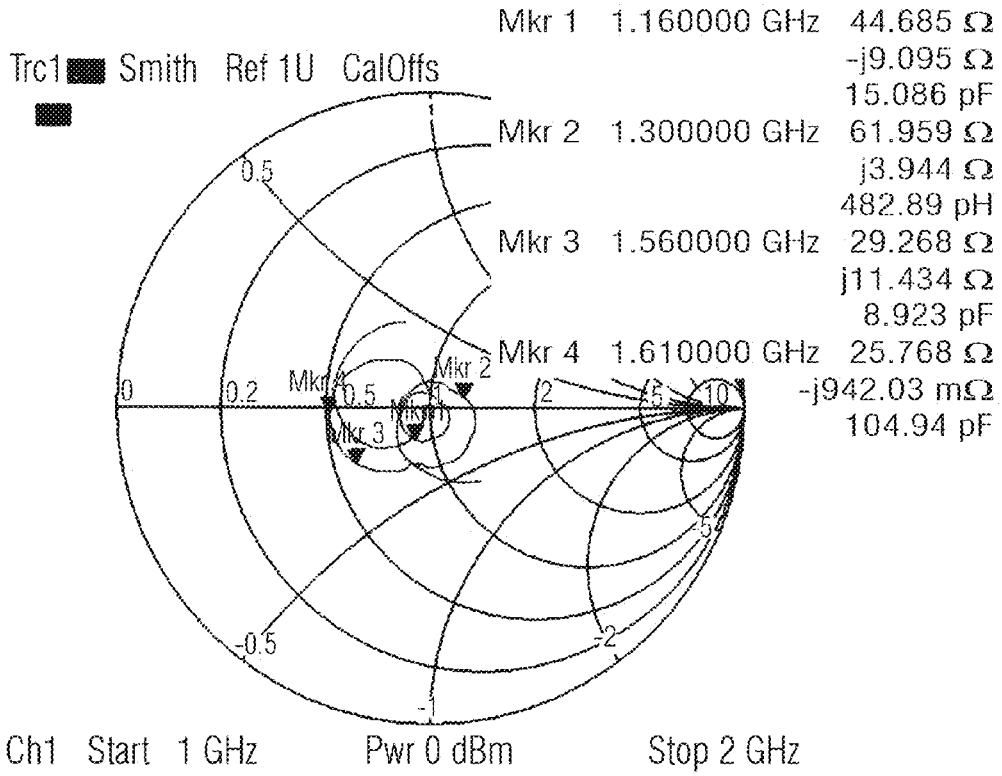
FIG. 5*c* shows a Smith diagram which illustrates the curve of the reflection coefficient of an embodiment of an antenna device.

FIG. 5*c* shows a Smith diagram which represents the measured curve of the reflection coefficient S11 of the GNSS antenna of FIG. 5*b*. In the curve represented, four points Mkr1-4 are marked at the frequencies 1.16, 1.30, 1.56, and 1.61 GHz, and the associated impedances are listed in the legend. The curve clearly reveals that the antenna may be matched such that all of the admittance values lie within a vicinity of the circle of the conductance G=1.

Figure 6A:
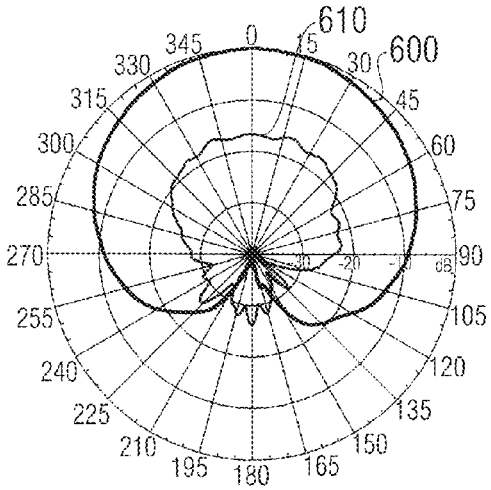
Figure 6B:
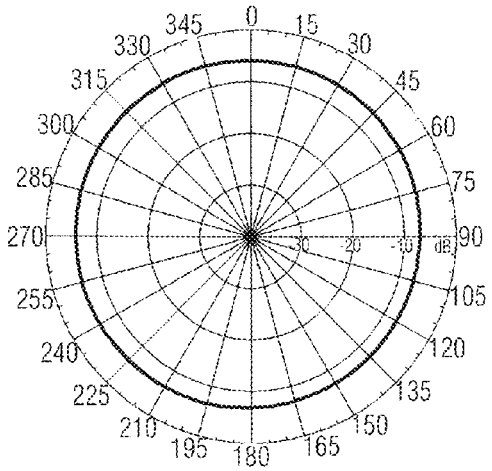

FIGS. 6*a*-*d* and the table of FIG. 6*e* list the measured radiation diagrams of the antenna of FIG. 5*b*. The matching of the antenna in the upper frequency range may be further optimized in embodiments. FIG. 6*a* shows a horizontal antenna diagram, the outer curve 600 corresponding to right-handed circular polarization, the inner curve 610 corresponding to left-handed circular polarization. FIG. 6*a* shows the curve at a vertical angle of 0°, i.e. into the direct horizontal direction orthogonal to the ground plane 110 of the antenna device 100 at a frequency of 1.16 GHz. One may clearly see that the 10 dB beamwidth is clearly larger than 150°. For the same frequency, FIG. 6*b* shows a nearly vertical antenna diagram for an angle of 70° around the direct horizontal direction. The curve depicted in FIG. 6*b* was determined for right-handed circular polarization and clearly shows that the antenna gain comprises a high level of uniformity in all directions.

Figure 6C:
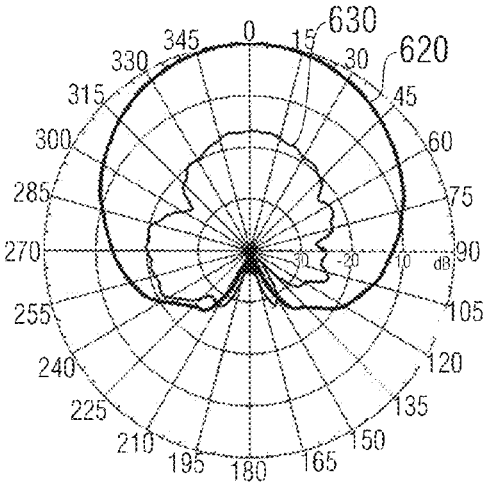
Figure 6D:
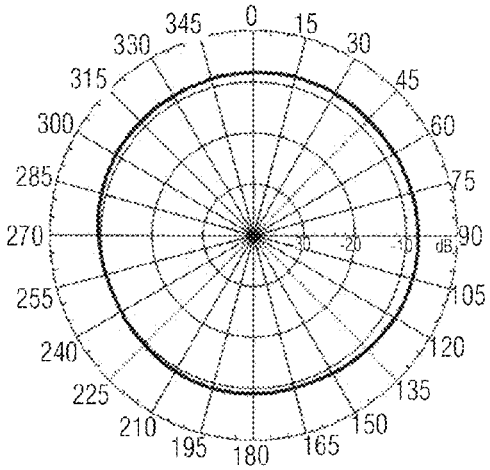
Figure 9:
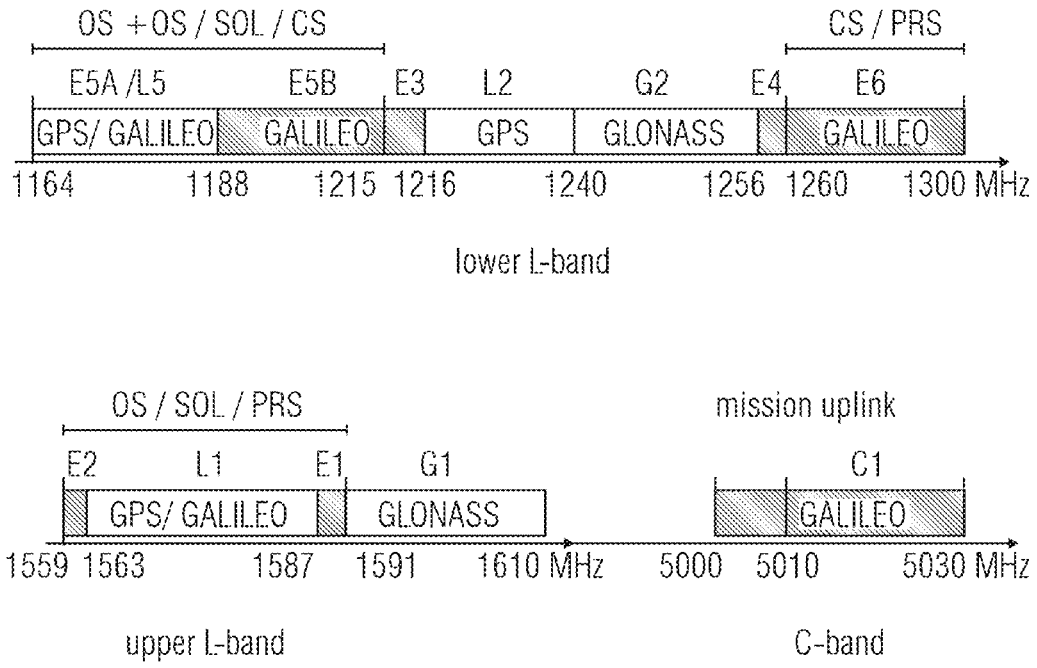
FIGURE 9 (PRIOR ART)
FIG. 9 shows a conventional frequency plan.

FIG. 6*c* shows two diagrams, a diagram 620 for right-handed circular polarization, and a diagram 630 for left-handed circular polarization. Both diagrams were taken at a frequency of 1.61 GHz and detected in a direct horizontal direction. One may recognize that the 10 dB beamwidth is larger than 150°. FIG. 6*d*, in turn, shows a nearly vertical antenna diagram for an angle of 70° from the horizontal direction, at a frequency of 1.61 GHz. The curve of FIG. 6*d* was determined for right-handed circular polarization and also depicts a high level of uniformity of the antenna gain across all directions of incidence.

The table depicted in FIG. 6*e* comprises a combination of the maximum antenna gains, which have been determined at the various frequencies, and of 10 dB beamwidths. Here, too, one may see that with embodiments of the present invention, an increase in the 10 dB beamwidth may be achieved across a broad frequency range.

In accordance with the inventive production method it is possible, in embodiments, to produce an antenna device such that the parasitic elements 130 are initially partly released from a ground plane 110. FIG. 7 schematically shows an embodiment of such a method step. The circular ground plane 110 is initially processed, for example using a laser or a saw, such that the contours of the parasitic elements 130 are released. Subsequently, a step of bending up the parasitic elements is performed, so that a structure in accordance with the antenna device depicted in FIG. 5*b* is achieved.

In addition, the inventive production method of producing a radiator 120 may comprise a step of bending a radiator 120 from a square shape. FIG. 8 shows such a radiator 120, which initially is present in a square or grid-square shape. The corners are now bent, or adapted, such that the inner square results. FIG. 5*b* shows an embodiment of an inventive antenna device comprising a ground plane 110 and parasitic elements 130 in accordance with FIG. 7, and a radiator 120 in accordance with FIG. 8.

Embodiments of the present invention offer the advantage that with antenna devices, a larger beamwidth of the radiation characteristic may be achieved, in the frequency range of navigation systems, with the same antenna gain. This advantage is achieved by means of a geometric arrangement of a ground plane, a radiator and parasitic elements, so that these antenna systems may be implemented at very low cost, which represents a further major advantage of embodiments of the present invention.

In embodiments of the antenna device 100, the ground plane 110 may comprise metallic material. The ground plane 110 may be configured to be circular, oval, square or rectangular. The radiator 120 may be configured to be circular, oval, square or rectangular. The radiator 120 may further be configured as a microstrip line radiator and/or comprise a contacting which is passed through the ground plane 110. In embodiments, a parasitic element 130 may be configured to be rod-shaped, cubic or sector-shaped. A parasitic element 130 may be configured as an element which is partly worked from the ground plane 110.

In embodiments of the antenna device 100, the matching or feed network 300 may be arranged on that side of the ground plane 110 which is opposite the radiator 120. The matching or feed network 300 may comprise a rat-race divider 312 or a Wilkinson divider 314; 316. The matching or feed network 300 may further comprise a stub 326, a transformer 322 or a transformer line 322.

In embodiments of the antenna device 100, same may be configured for transmitting and receiving circularly polarized signals.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An antenna device for transmitting and receiving electromagnetic signals, comprising:

a ground plane;

a radiator; and a plurality of parasitic elements arranged, on the ground plane, around the radiator in a radially symmetric manner, the parasitic elements being permanently electrically shunted to the ground plane and being arranged such that a beamwidth of the radiation pattern of the antenna device is enlarged, wherein the radiator is a single unitary structural member including a square main radiator portion and a plurality of triangular leg radiator portions extending from the square main radiator portion, and a side of each of the triangular leg radiator portions is connected to the square main radiator portion and extends downward from the square main radiator portion such that a vertex of each of the triangular leg radiator portions is in contact with a feed network arranged on a side of a printed circuit board or the ground plane and the square main radiator portion is arranged at a distance away from the ground plane.

2. The antenna device as claimed in claim 1, wherein the parasitic elements are arranged such that they cause an enlargement of the beamwidth of the radiation pattern at a higher frequency, and an increase in an antenna gain at a lower frequency.

3. The antenna device as claimed in claim 1, wherein the beamwidth of the radiation pattern comprises a 10 dB beamwidth of at least 150°.

4. The antenna device as claimed in claim 3, wherein the beamwidth of the radiation pattern comprises a 10 dB beamwidth within a frequency range from 1.16 to 1.61 GHz.

5. The antenna device as claimed in claim 1, wherein a wavelength of the electromagnetic signals ranges from 0.15 m to 0.3 m.

6. The antenna device as claimed in claim 5, wherein the ground plane comprises a surface area which falls below the square of a wavelength of the electromagnetic signals, and wherein the distance falls below a wavelength of the electromagnetic signals.

7. The antenna device as claimed in claim 5, wherein two parasitic elements of the plurality of parasitic elements comprise an element distance among each other of less than a wavelength of the electromagnetic signals or less than a quarter of the wavelength of the electromagnetic signals.

8. The antenna device as claimed in claim 1, wherein the electromagnetic signals are configured in accordance with the GPS, the Galileo or the GLONASS system.

9. The antenna device as claimed in claim 1, wherein a parasitic element was partly released from the ground plane and was erected.

10. The antenna device as claimed in claim 1, comprising more than four or more than seven parasitic elements.

11. The antenna device as claimed in claim 1, further comprising a matching network.

12. A production method of producing an antenna device for transmitting and receiving electromagnetic signals, comprising:

forming a radiator defined by a single unitary structural member that includes a square main radiator portion and a plurality of triangular leg radiator portions by bending the plurality of triangular leg radiator portions from the square main radiator portion to define the radiator, such that a side of each of the triangular leg radiator portions is connected to the square main radiator portion and extends from the square main radiator portion;

arranging the radiator such that a vertex of each of the triangular leg radiator portions is in contact with a feed network arranged on a side of a printed circuit board or a ground plane and the square main radiator portion is arranged at a distance away from the ground plane; and arranging a plurality of parasitic elements, on the ground plane, around the radiator in a radially symmetric manner, the parasitic elements being permanently electrically shunted to the ground plane and being arranged such that a beamwidth of the radiation pattern of the antenna device is enlarged.

13. The production method as claimed in claim 12, wherein arranging the parasitic elements comprises partly releasing parasitic elements from the ground plane.

14. The production method as claimed in claim 13, wherein partly releasing further comprises bending up or erecting the parasitic elements.

* * * * *

UNITED STATES PATENT AND TRADEMARK OFFICE

CERTIFICATE OF CORRECTION

PATENT NO. : 8,624,792 B2
APPLICATION NO. : 12/524937
DATED : January 7, 2014
INVENTOR(S) : Popugaev et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 445 days.

Signed and Sealed this
Twenty-second Day of September, 2015

Michelle K. Lee

Michelle K. Lee
*Director of the United States Patent and Trademark Office*